US007171935B2

(12) United States Patent
Komai et al.

(10) Patent No.: US 7,171,935 B2
(45) Date of Patent: Feb. 6, 2007

(54) ENGINE CYLINDER LINER CONSTRUCTION

(75) Inventors: Hirokazu Komai, Aichi (JP); Takeshi Hasegawa, Kyoto (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 25 days.

(21) Appl. No.: 11/019,354

(22) Filed: Dec. 23, 2004

(65) Prior Publication Data

US 2005/0161014 A1 Jul. 28, 2005

(30) Foreign Application Priority Data

Dec. 25, 2003 (JP) ..... P 2003-431207

(51) Int. Cl.
*F02F 1/00* (2006.01)

(52) U.S. Cl. ..... 123/193.2

(58) Field of Classification Search ..... 123/193.2; 29/888.061

See application file for complete search history.

(56) References Cited

U.S. PATENT DOCUMENTS 1,437,904 A * 12/1922 Moomaw ..... 138/143
1,896,098 A * 2/1933 Poyer ..... 123/48 C
2,062,394 A * 12/1936 Brown ..... 165/180
2,126,089 A * 8/1938 Brown ..... 123/193.2
3,165,983 A * 1/1965 Thomas ..... 92/169.1
5,050,547 A * 9/1991 Takahashi ..... 123/193.2
5,199,166 A * 4/1993 Torigai et al. ..... 29/888.061
6,640,765 B2 * 11/2003 Land et al. ..... 123/193.2
6,925,981 B2 * 8/2005 Ibukuro et al. ..... 123/193.2

FOREIGN PATENT DOCUMENTS

JP 3-89955 U 9/1991
JP 2002-97998 A 4/2002

* cited by examiner

*Primary Examiner*—Marguerite McMahon
(74) *Attorney, Agent, or Firm*—Birch, Stewart, Kolasch & Birch, LLP

(57) ABSTRACT

An engine cylinder liner construction in which a cylinder liner that is cast into a cylinder block has a tubular portion and a number of spines integrally formed on an outer surface of the tubular portion, the engine cylinder liner construction includes a chamfered portion formed at an end portion m of the tubular portion which faces a cylinder head by chamfering the end portion together with the spines located thereat in a tapered fashion.

8 Claims, 4 Drawing Sheets

ENGINE CYLINDER LINER CONSTRUCTION

CROSS REFERENCES TO RELATED APPLICATION

This non-provisional application incorporates by reference the subject matter of Application No. 2003-431207 filed in Japan on Dec. 25, 2004, on which a priority claim is based under 35 U.S.C. §119(a).

BACKGROUND OF THE INVENTION

1. Field of the Invention

The present invention relates to an engine cylinder liner construction in which a cylinder liner is cast into a cylinder block, and more particularly to an engine cylinder liner construction in which projections are formed on an outer surface of the cylinder liner so as to strengthen the adhesion properties of the cylinder liner to the cylinder block.

2. Description of the Related Art

There have been adopted lots of engines in which a cylinder block main body is made of aluminum alloy with a view to reducing the weight thereof. Incidentally, in the aluminum alloy-made cylinder block of this type, in many cases, separate cylinder liners of cast iron or steel alloy are integrally cast into the cylinder block at the time of producing a cylinder block main body with a view to increasing wear resistance against pistons. In this case, cylinder liners are cast or pressed into the cylinder block. An example of such a pressing process is disclosed in JP-UM-A-3-89955.

Incidentally, in a case where the casting process is adopted to produce engines in which cylinder liners are cast into a cylinder block, when casting cylinder liners made of a different material into the cylinder block, due to the difficulty in making the cylinder block to completely adhere to the cylinder liners at the time of producing a cylinder block main body, minute gaps are produced between the cylinder block and the cylinder liners with time, and there are caused problems of reduction in accuracy of the roundness of the cylinder liner and of reduction in cooling performance thereof.

In a cylinder block disclosed in JP-A-2002-97998, for example, the adhesion properties of cylinder liners to a cylinder block are attempted to be secured by casting into the cylinder block cylinder liners each having a large number of spines or prickles which are formed on an outer surface thereof. Note that in this cylinder block, spines are eliminated between the adjacent cylinder liners so as to suppress the casting failure in facing gaps between the adjacent cylinder liners to thereby prevent the reduction in rigidity.

Incidentally, a cylinder head is superposed on the cylinder block via a gasket, and both the cylinder head and the cylinder bock are fastened together with bolts. As this occurs, in the cylinder block 100 shown in FIG. 6A, a relatively large fastening load W is applied to an upper end face fh which faces the cylinder head 120 of a cylinder liner 110 in which a piston is fitted in a press contact direction via the gasket 130. In this case, while a casting portion 140 where the cylinder liner 110, which is spiny, is cast, can function to secure the adhesion properties between the casting portion 140 and the cylinder liner 110, there exists a possibility that a gap is produced with time in a joint portion b between the casting portion 140 on the cylinder block 100 side and the cylinder liner 110 due to the fastening load w so applied and fluctuation in the gas pressure received by the cylinder head 120, and with the production of such a gap in the joint portion b, a damaged portion C tends to be easily produced in the gasket 130 in association with the gap production. Moreover, a crack 170 tends to be easily produced in a distal end of a needle-like projection 180 which is formed in the vicinity of the end portion of the cylinder liner 110 which faces the cylinder head 120 in association with the concentration of stress thereat, and this tends to produce a damaged portion C in a portion of the gasket 130 which faces the cracks so produced in the end portion of the cylinder liner 110, resulting in an easy-occurring problem that the sealing properties are reduced.

SUMMARY OF THE INVENTION

As shown in FIG. 6B, in a cylinder block 100*b* having a neck portion n which connects a main part of a casting portion 140*b* and an extended portion 141 and into which a spiny liner 110*b* having needle-like projections 180 is cast, while a minute displacement can be solved, there exists a possibility that a crack 170 is produced in a distal end of a needle-like projection 180 which is formed in the vicinity of the end portion of the cylinder liner 110*b* which faces the cylinder head 120 in association with the concentration of stress thereat. In case the crack 170 is generated in the neck portion n, a gas escaping route rg is formed as shown in FIG. 6B, and since this causes a problem that the sealing properties are reduced, it is desired to ensure the prevention of generation of the cracks 170.

The invention was made based on the problem, and a primary object thereof is to provide an engine cylinder liner construction which can suppress the generation of a crack in the vicinity of an end portion of a joint portion between the casting portion of the cylinder block and the cylinder liner having spines to thereby prevent the reduction in sealing properties of combustion gases.

A secondary object of the invention is to provide an engine cylinder liner construction which can ensure the suppression of the generation of a crack in the vicinity of an extended portion on a cylinder block main body side to thereby prevent the reduction in sealing properties due to a damage to a cylinder gasket when applied to a cylinder block into which a cylinder liner having projections is cast while an end portion of the cylinder liner which faces the cylinder head is covered with the extended portion from the cylinder head side.

According to a first aspect of the invention, there is provided an engine cylinder liner construction in which a cylinder liner that is cast into a cylinder block has a tubular portion and a large number of spines integrally formed on an outer surface of the tubular portion, the engine cylinder liner construction comprising, a chamfered portion formed at an end portion of the tubular portion which faces a cylinder head by chamfering the end portion together with the spines located thereat.

According to a second aspect of the invention, there is provided an engine cylinder liner construction in which a cylinder liner that is cast into a cylinder block has a tubular portion and a large number of spines integrally formed on an outer surface of the tubular portion, and in which the cylinder liner is so cast while an end portion of the cylinder liner which faces a cylinder head adapted to be fastened to the cylinder block is being covered with an annular extended portion on the cylinder block side from the cylinder head side, the engine cylinder liner construction a chamfered portion formed at an end portion of the tubular portion which faces a cylinder head by chamfering the end portion together with the spines located thereat.

According to a third aspect of the invention, there is provided an engine cylinder liner construction as set forth in the first or second aspect of the invention, wherein the chamfered portion is such that an angle of inclination relative to a cylinder center line is set to be about 12° to 30°.

According to a fourth aspect of the invention, there is provided an engine cylinder liner construction as set forth in the first, second or third aspect of the invention, characterized in that a portion between the chamfered portion and an end face of the tubular portion which faces the cylinder head is rounded.

According to the first aspect of the invention, since the chamfered portion is formed at the end portion of the tubular portion positioned in the vicinity of the end portion of the joint portion between the cylinder block and the cylinder liner or positioned on the cylinder head side by chamfering the end portion together with the spines located thereat in a tapered fashion, the spines located in the vicinity of the end portion of the joint portion can be removed so as to suppress the generation of a crack from the spines to thereby suppress the generation of damage to the cylinder gasket due to a crack that would otherwise be generated, thereby making it possible to ensure the prevention of reduction in sealing properties between the cylinder block and the cylinder head.

According to the second aspect of the invention, since the chamfered portion is formed at the end portion of the tubular portion positioned in the vicinity of the end portion of the joint portion between the cylinder block and the cylinder liner or positioned on the cylinder head side by chamfering the end portion together with the spines located thereat in a tapered fashion, the spines located in the vicinity of the extended portion which covers the end portion of the cylinder liner which faces the cylinder head can be removed so as to suppress the generation of a crack from the spines in the vicinity of the extended portion to thereby suppress the generation of damage to the cylinder gasket due to a crack that would otherwise be generated, thereby making it possible to ensure the prevention of reduction in sealing properties between the cylinder block and the cylinder head.

According to the third aspect of the invention, since the angle of inclination of the chamfered portion formed at the end portion of the tubular portion is set to be about 12° to 30°, when the fastening load, which varies to be increased or decreased in accordance with a variation in the gas pressure, is applied to the chamfered portion via the extended portion, a component of the fastening load which is divided in a radial direction of a cylinder is suppressed to thereby suppress, in turn, an inclined displacement of the end portion of the joint portion of the tubular portion to the cylinder block into the interior of the cylinder, and moreover, since the spines are cut within a range where a cut with of the chamfered portion in an axial direction of the cylinder does not become too large, the reduction in adhesion properties between the tubular portion and the cylinder block can be prevented.

According to the fourth aspect of the invention, since the chamfered portion and the end face of the tubular portion which faces the cylinder head are rounded so as to eliminate any edge-like shape thereat, the generation of a crack in the extended portion in the vicinity of the rounded overlapping portion R can be prevented in an ensured fashion, in particular, together with the advantage of the formation of the chamfered portion at the end portion of the tubular portion which faces the cylinder head by chamfering the end portion together with the spines located thereat, the generation of a crack in the vicinity of the end portion of the joint portion between the tubular portion and the cylinder block can be prevented in a more ensured fashion.

BRIEF DESCRIPTION OF DRAWINGS

FIGS. 3A and 3B are views showing a joined end portion of a cylinder liner and a casting portion in the engine cylinder liner construction shown in FIG. 1, wherein FIG. 3A is an enlarged explanatory view of a cut-away portion, and FIG. 3B is a load effect explanatory view at the cut-away portion;

FIGS. 5A and 5B are enlarged cut-away sectional views showing main parts of a joined end portion of a cylinder liner and a casting portion in an engine cylinder liner construction as another embodiment of the invention, wherein FIG. 5A shows a first modified example and FIG. 5B shows a second modified example; and FIGS. 6A and 6B are enlarged cut-away sectional views showing main parts of a joined end portion of a cylinder liner and a casting portion in a conventional engine cylinder liner construction, wherein FIG. 6A shows a first conventional example, and FIG. 6B shows a second conventional example.

DETAILED DESCRIPTION OF THE INVENTION

Figure 1:
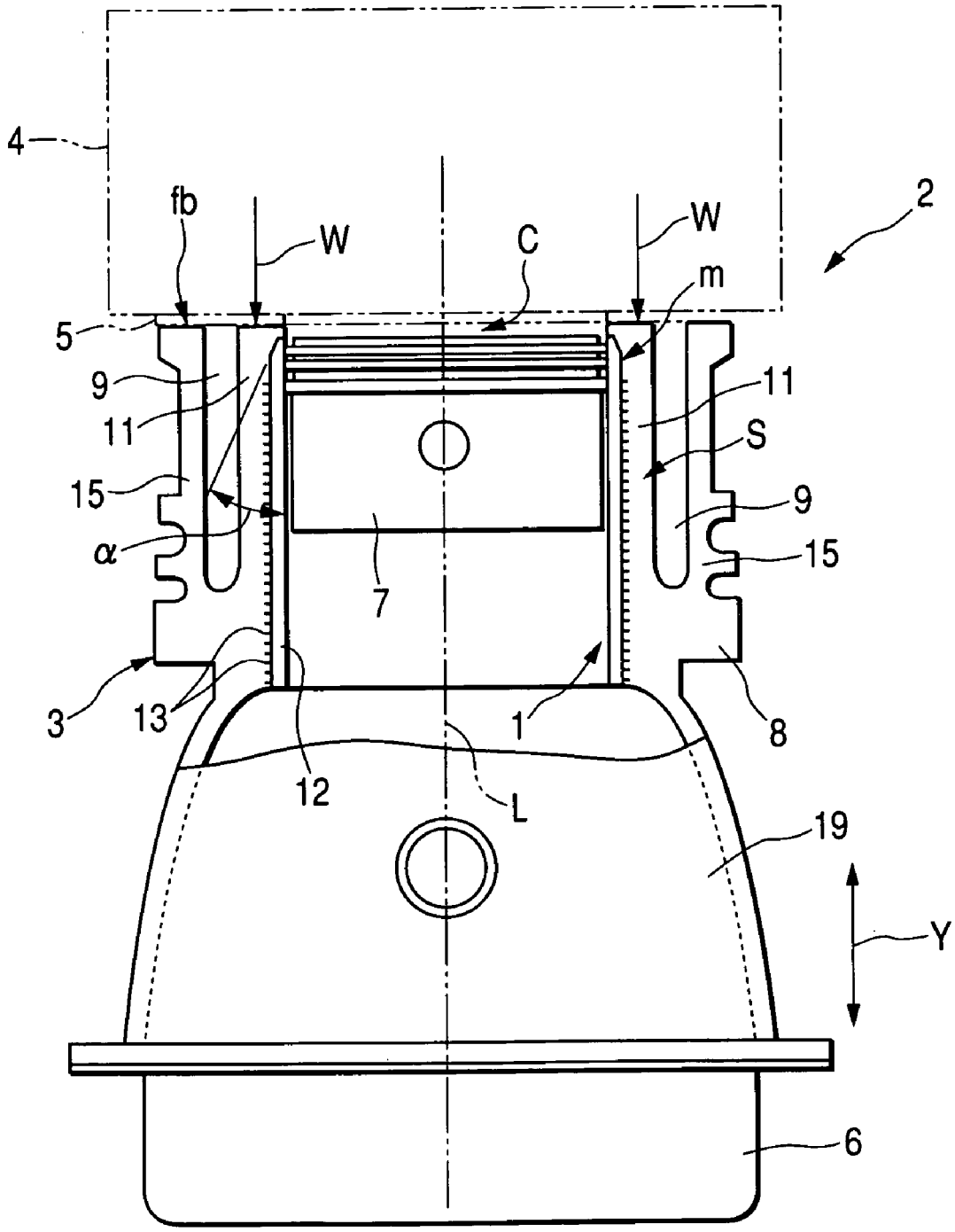
FIG. 1 is a schematic view showing the overall construction of an engine to which an engine cylinder liner construction as an embodiment of the invention is applied.

A gasoline engine (hereinafter, simply referred to as an engine) 2 adopting a cylinder block to which a cylinder liner construction as an embodiment of the invention is applied is shown in FIG. 1.

A main body of the engine 2 has a cylinder block 3 into which a cylinder liner 1 is cast, a cylinder head 4 and a head cover, not shown, which are sequentially connected together to an upper side of the cylinder block 3 in that order and an oil pan 6 which is integrally connected to a lower side of the cylinder block 3. The engine 2 is a multi-cylinder engine having a plurality of cylinders S which are formed into the same configuration, a piston 7 is disposed in each cylinder S in such a manner as to slide vertically, and a combustion chamber is defined by the cylinder liner 1, the piston 7 and a lower wall of the cylinder head 4 in such a manner that the capacity thereof can be changed.

A gasket 5 is disposed between the cylinder block 3 and the cylinder head 4, which is placed on the upper side of the cylinder block 3, and the cylinder block 3 and the cylinder head 4 are strongly and integrally fastened together by tightening head bolts, not shown, with the gasket 5 being held therebetween. A fuel supply system, intake and exhaust systems and a valve driving system or a valve train, which are all not shown, are mounted on the cylinder head 4, whereby the flow control of fuel supplied to the combustion chamber C in each cylinder, intake gas drawn into the combustion chamber C and exhaust gas exhausted from the combustion chamber C can be implemented.

Figure 4:
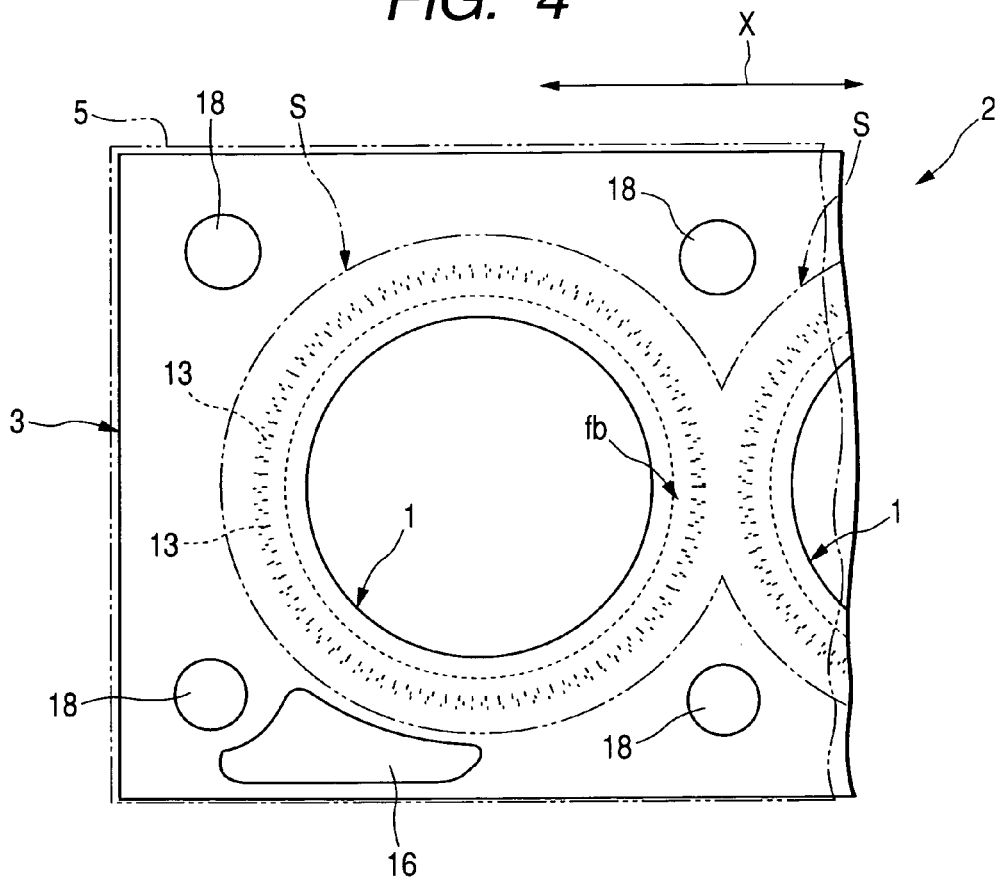
FIG. 4 is an enlarged cut-away sectional view showing the main part of the cylinder upper portion in the engine cylinder liner construction shown in FIG. 1, which is a cut-away plan view showing a main part of a cylinder block.

In the cylinder block 3 to which the engine cylinder liner construction according to the invention is applied, a plurality of cylinders S are disposed in a straight line along a longitudinal direction X of the series of cylinders (refer to FIG. 4) which constitutes a vertical direction to the surface of the drawing as viewed in FIG. 1, a water jacket 9 is formed in such a manner as to surround outer circumferences of the cylinders S, and an outer circumference of the water jacket 9 so formed is surrounded by an external wall portion 15. Moreover, a communication port 16 (refer to FIG. 4) is formed in the cylinder block 3 at an end thereof in the longitudinal direction X of the external wall portion 15 so that a coolant from a water pump, not shown, is allowed to flow thereinto so as to continue to flow further into a water jacket, not shown, which is formed in the cylinder head 4. Note that reference numeral 18 shown in FIG. 4 denotes a through hole through which a head bolt, not shown, is passed to fasten the cylinder head 4 to the cylinder block 3.

The cylinder block 3 is cast using a high-pressure die casting method in which a molten aluminum alloy is cast into a mold under high pressure, and cast together are a cylinder block main body 8, a plurality of cylinder liners 1 which are cast into the cylinder block main body 8, the water jacket 9 formed to surround the outer circumferential portions of the respective cylinders s, the external wall portion 15 which surrounds the outer circumference of the water jacket 9 so formed and a crankcase 19 which constitutes a lower portion of the cylinder block main body 8.

Each cylinder S in the cylinder block 3 is made up of the cylinder liner 1 and a casting portion 11 on the cylinder block main body 8 side into which the entirety of an outer surface of the cylinder liner 1 is cast. Here, the whole area of the outer surface of the cylinder liner 1 is cast by the casting portion 11 while an end portion m of a joint portion between the cylinder liner 1 and the casting portion 11 which is situated at an upper end in a vertical direction Y constituting a direction of the axis L of the cylinder and which faces the cylinder head 4 is being covered with an extended portion 14 which is caused to extend from the casting portion 11 via a neck portion n.

The extended portion 14 caused to extend from the upper end of the casting portion 11 towards the axis L of the cylinder is formed in such a manner as to cover the joined end portion m constituting an upper end of a tubular portion 12 in an annular fashion from the cylinder head 4 side. Upper wall surfaces fb of the casting portion 11 and the extended portion 14, which are both situated on the cylinder block 3 side, are formed in such a manner as to be situated on the same plane and to protrude in the vertical direction Y, which constitutes the direction of the axis L of the cylinder by an extended width d (refer to FIG. 2) relative to the joined end portion m, whereby the upper wall surfaces fb of the casting portion 11, the external wall portion 15 and the extended portion 14 are formed such that the cylinder head 4 is brought into a close press contact with the upper wall surfaces fb via the gasket 5. By the provision of the extended portion 14, a joint surface F between the vicinity of the joined end portion m of the cylinder liner 1 which faces the cylinder head 4 and the casting portion 11 is prevented from being caused to face the gasket 5, thereby the neck portion being prevented from being damaged by the relative displacement of the both members.

Figure 2:
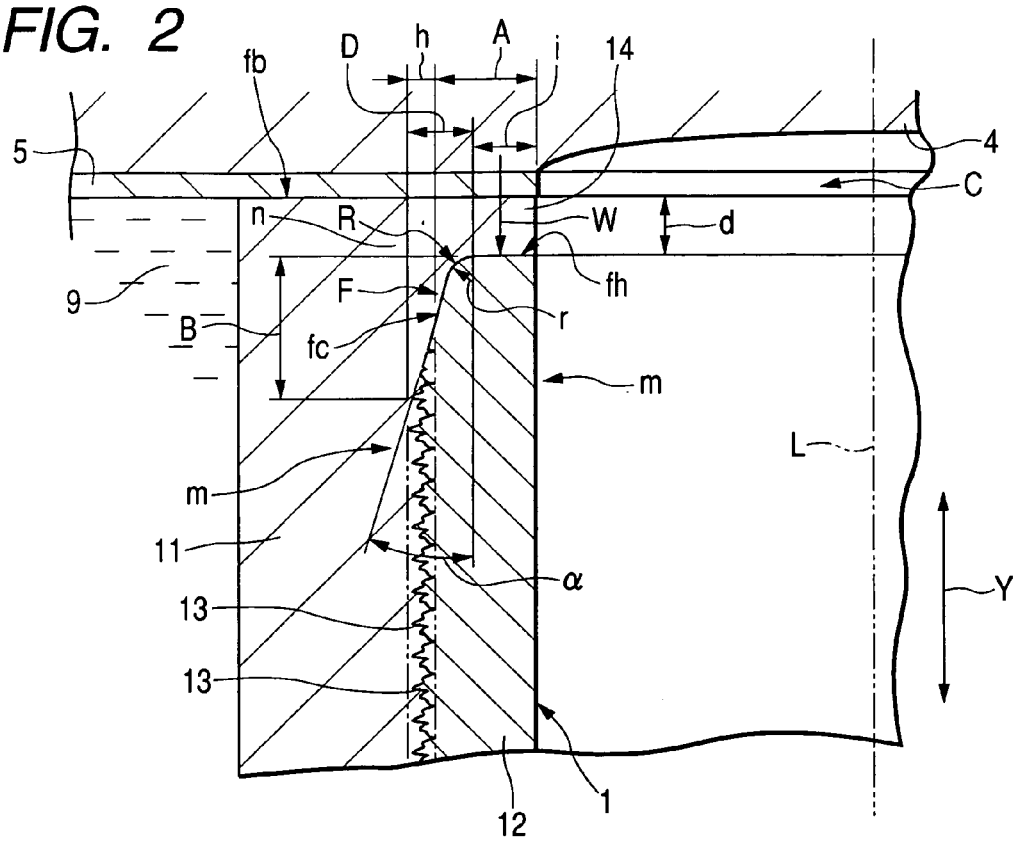
FIG. 2 is an enlarged cut-away sectional view showing a main part of a cylinder upper portion in the engine cylinder liner construction shown in FIG. 1.
Figure 3A:
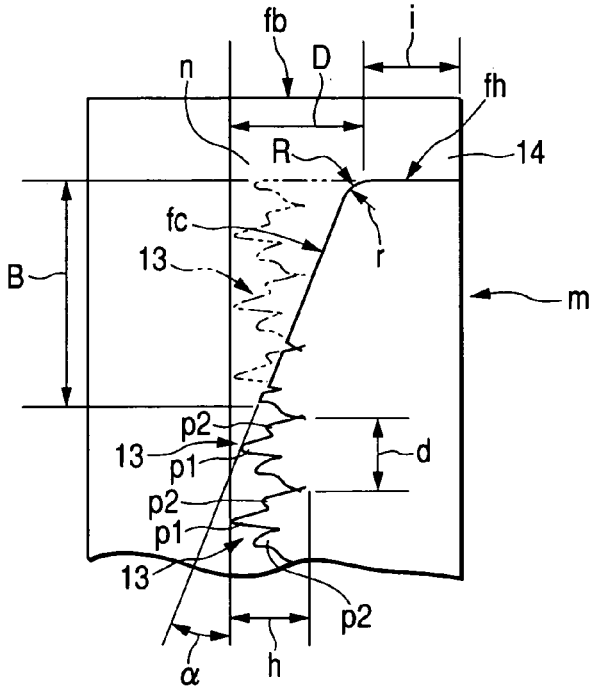

The cylinder liner 1 contains cast iron and is cast as a cylinder liner, and more particularly, as a spiny liner including the tubular portion 12 and a large number of spines 13 as projections which are provided on an outer surface of the tubular portion 12 in such a manner as to protrude therefrom, whereby the adhesion properties of the cylinder liner 1, which is the spiny liner, to the casting portion 11 is ensured. As shown in FIGS. 2, 3A, each spine 13 has the same shape and constitutes a multi-projection dispersed support body of a protrusion width h and a proximal end width d in the vertical direction Y which includes a larger protruding portion p1 and a plurality of smaller protruding portion p2 situated around the larger protruding portion p1. Each spine 13 attempts to increase the surface area thereof by forming the respective protruding portions p1, p2 and is formed in such a manner as to sufficiently increase the contact area thereof to the molten aluminum alloy which constitutes the casting portion 11 on the cylinder block side 3, which casting portion 11 is then joined to the spine 13 so formed, thereby ensuring the adhesion properties of the spine 13 to the casting portion 11.

The cylinder liner 1 is chamfered by a tapered cut surface fc where the joined end portion m of the cylinder liner 1, which is the upper end portion thereof in the vertical direction which faces the cylinder head 4, and the spines 13 (indicated by double-dashed chain lines in FIG. 3A) situated in the joined end portion m constitute part of the joint surface F. To be specific, as shown in FIGS. 2, 3A, in the tapered cut surface fc, the angle of inclination relative to the center line L of the cylinder is set to be 15°. Moreover, the tapered cut surface fc is cut a cut width B from the joined end portion m towards the direction of the axis L of the cylinder with an end mill or the like so as to be formed as an annular tapered surface (conical surface). In addition, a cut position formed in the radial direction of the cylinder on an upwardly oriented surface fh of the tapered cut surface (the chamfered surface) which faces the joined end portion m is formed by cutting a larger width D than a protruding width h of the spike 13, whereby the width i of the upwardly oriented surface fh at the joined end portion m is secured in a predetermined amount, so that part of the fastening load W can be borne also by the tubular portion 12 in a proper fashion.

In contrast, in the event that the cut width B in the vertical direction Y is too large, the adhesion properties between the casting portion 11 on the cylinder block 3 side and the vicinity of the joined end portion m of the cylinder liner 1 are reduced, whereas in the event that cut width B is too small, the protruding end of the spike 13 comes too close to the neck portion n of the extended portion 14, whereby the function to suppress the generation of a crack is deteriorated. Due to this, while the cut width B is experimentally set depending on cylinder liners 1, generally, the cut width B is set within a range of values which ranges from a value corresponding to the addition of the thickness A of the tubular portion 12 and the protruding width h of the spike 13 to a value on the order of two times larger than the value resulting from the addition.

Furthermore, while the angle of inclination of the tapered cut surface fc is set to 15°, this value desirably ranges within 3° plus or minus from 15°, and the angle of inclination may range between 12° to 30° as the case may be, the reason for this being described below.

Figure 3B:
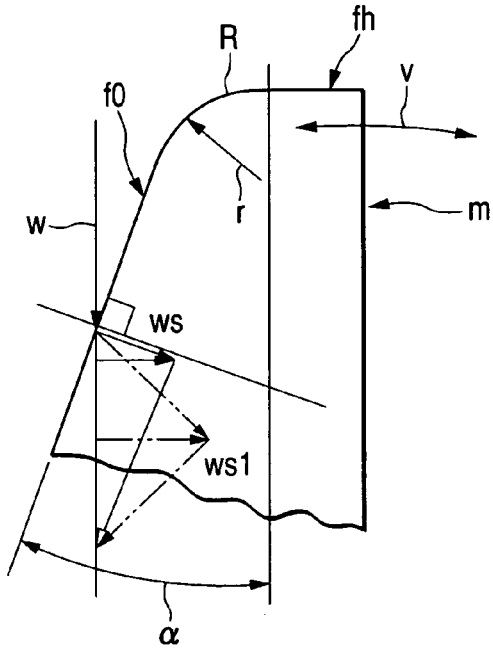

The fastening load W is applied from the extended portion to the tapered cut surface fc and the upwardly oriented surface fh of the joined end portion m of the tubular portion 12 which follows the tapered cut surface fc. Of the fastening load W so applied, a fastening load W applied to the tapered cut surface fc is, as shown in FIG. 3B, generating a divided component ws in the radial direction of the cylinder. Assuming that the fastening load W is constant, the magnitude of the divided component ws in the radial direction of the cylinder reaches its maximum when the angle of inclination of the tapered cut surface fc is 45° (shown by double-dashed chain lines in FIG. 3B) and reduces at an angle of inclination which is smaller or larger than the angle at which the maximum is produced.

Here, in the event that the fastening load W is applied when the angle of inclination is 45°, the divided component ws in the radial direction of the cylinder is relatively large and the inclined displacement of the joined end portion m of the tubular portion 12 towards the axis L of the cylinder is facilitated, whereby the possibility is increased that the relative displacement between the upper end of the casing portion 11 and the extend portion 14 is enhanced.

In contrast to this, in the event that the angle of inclination is reduced from 45°, the divided component ws in the radial direction of the cylinder becomes relatively small, the inclined displacement of the joined end portion m of the tubular portion 12 towards the axis L of the cylinder can be suppressed. In case the angle of inclination is too small, or in case the angle is set to a value which is smaller than 12°, for example, however, the cut width B from the joined end portion m becomes excessively large, and as this occurs, the reduction in adhesion properties of the casing portion 11 on the cylinder block 3 side to the vicinity of the joined end portion m of the cylinder liner 1 is facilitated.

On the contrary, in case the angle of inclination becomes excessively large (for example, 80°), the cut width B from the joined end portion m becomes excessively small, and as this occurs, the protruding end of the spike 13 comes too close to the main part of the casting portion 11 and the neck portion n of the extended portion 14 which continues therefrom, whereby the crack generation suppressing function is deteriorated. Due to this, the angle of inclination is desirably in the range of 3° plus and minus from 15°, and when the angle of inclination is in the range of 12° to 30°, the protruding end of the spike 13 is refrained from coming close to the neck portion n, whereby a risk is eliminated that the cut width B is increased excessively to thereby cut the spike 13, the adhesion properties of the casting portion 11 to the joined end portion m of the cylinder liner 1 being thereby deteriorated.

Furthermore, in the joined end portion m of the tubular portion 12 of the cylinder liner 1, the overlapping portion R between the tapered cut surface fc and the upwardly oriented surface fh which follows the tapered cut surface fc and faces the cylinder head is rounded or radiused. By radiusing the overlapping portion R, the stress is attempted to be dispersed at the neck portion n of the extended portion 14 which faces the overlapping portion R, whereby the generation of a crack in the vicinity of the neck portion n is suppressed as well. Thus, the joined end portion m of the tubular portion 12 and the spikes 13 located in the joined end portion m are chamfered by the tapered cut surface fc, and in addition to this, the overlapping portion R between the tapered cut surface fc and the upwardly oriented surface fh is radiused, whereby the generation of a crack in the neck portion n in the vicinity of the joined end portion m can be prevented in a further ensured fashion.

In the engine 2 utilizing the cylinder block 3 to which the invention is applied, the cylinder head 4 and the cylinder block 3 are fastened to each other by head bolts with the gasket 5 being held therebetween, whereby the gas tightness at the joint surface between the cylinder head 4 and the cylinder block 3 is secured by the predetermined fastening load W applied to the joint surface. When the engine 2 is running, the combustion pressure in the combustion chamber C changes in an intermittent fashion, and in association with the change, the fastening load W changes to rise and fall, whereby the press contact state between the upper wall surfaces fb of the external wall portion 15 in the vicinity of the upper wall side of the cylinder block 3, the casting portion 11 and the extended portion 14 and the cylinder head 4 via the gasket 5 changes. As this occurs, the fastening load W from the main part of the extended portion 14 is borne by the upwardly oriented surface fh of the tubular portion 12 in the vertical direction. In contrast, the fastening load W borne by the neck portion n of the extended portion 14 is applied to the tapered cut surface fc, as shown in FIG. 3B, and part of the fastening load so borne works to press against the joined end portion m of the tubular portion 12 towards the axis L of the cylinder as the divided component ws in the radial direction of the cylinder to thereby generate a displacement V. However, since the joining properties between the casting portion 11 and the spikes 13 which constitute the outer surface of the tubular portion 12 are held strongly in the joined end portion m of the tubular portion 12 at an area thereof which is situated below the cut width B, and the rigidity in configuration on the joined end portion m side is sufficiently secured, whereby the displacement V is suppressed.

Figure 6A:
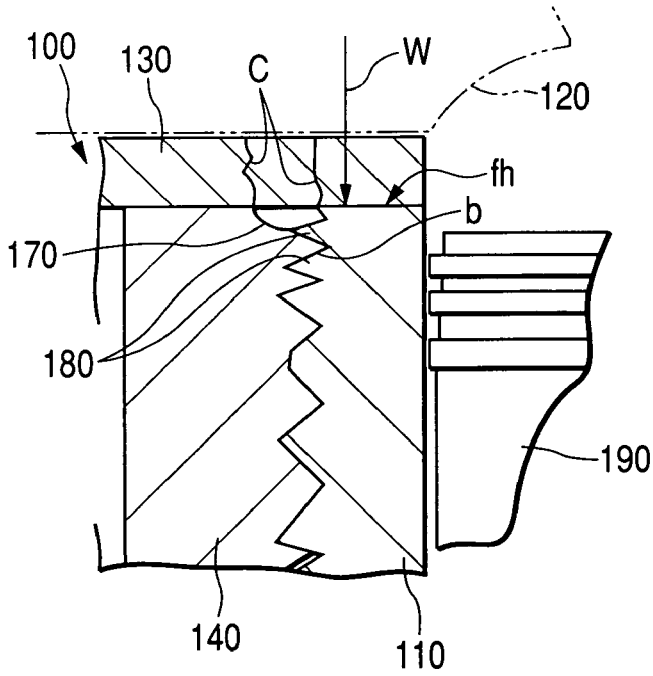
Figure 6B:
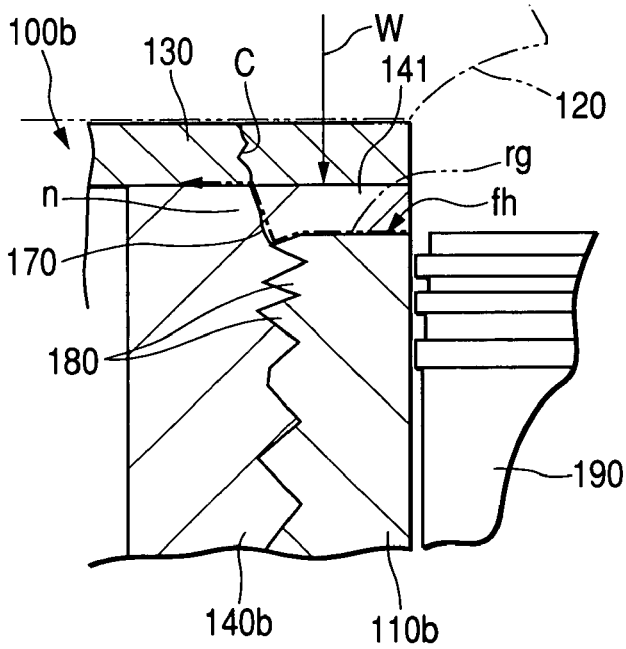

Furthermore, since the joining properties between the casting portion 11 and the spikes 13 which constitute the outer surface of the tubular portion 12 are held strongly, the relative displacement between the casting portion 11 and the spikes 13 is eliminated, and the relative displacement between the upper ends of the joined end portion m and the casting portion 11 which are situated thereabove and the neck portion n is also eliminated. In particular, since the spikes 13 in the casting portion 11 are removed over the cut width B from the vicinity of the neck portion n, the generation of a crack (refer to reference numeral 170 in FIG. 6B) in the distal end of the spike 13 due to the concentration of stress thereat can be prevented, and moreover, the generation of a crack (refer to reference numeral 170 in FIG. 6B) is also prevented in the further ensured fashion by radiusing r the overlapping portion R.

Thus, in the cylinders S in the cylinder block 3 to which the cylinder liner construction of the invention is applied, the casting portion 11 and the cylinder liner 1 having the spikes 13 on the outer surface thereof are caused to adhere to each other strongly, and the extended portion 14 is provided on the casting portion 11 via the neck portion n, whereby the gasket 5 is prevented from facing the joint surface F directly, so that the reduction in sealing properties between the cylinder block 3 and the cylinder head 4 can be prevented in an ensured fashion.

Moreover, in particular, the tapered cut surface fc is formed at the inclination angle over the cut width B so as to remove the spikes 13, and the overlapping portion R between the tapered cut surface fc and the upwardly oriented surface fh is radiused, whereby, in the event that the fastening load W is applied from the cylinder head 4 side, the generation of a crack in the vicinity of the neck portion n is prevented in an ensured fashion, whereby the reduction in sealing properties, which would otherwise occur if a crack were generated to reach the upper wall surfaces fb of the casing portion 11 and the extended portion, is prevented. Thus, by this construction, the reduction in sealing properties between the cylinder block 3 and the cylinder head 4 can also be prevented in an ensured fashion.

Figure 5A:
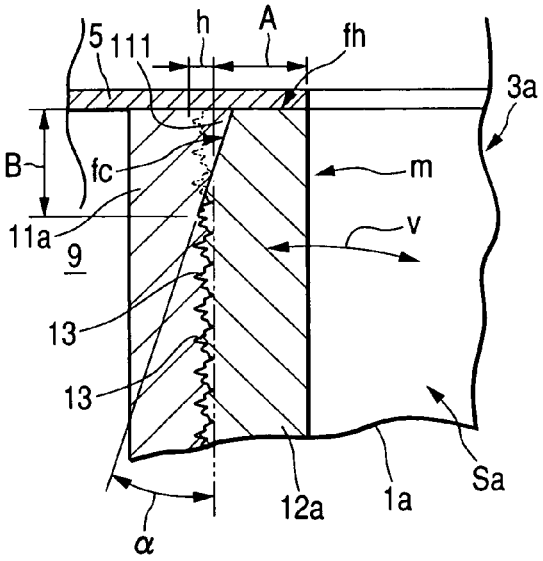

In the cylinder block 3 shown in FIG. 1, while the extended portion 14 is provided in the casting portion 11 via the neck portion n, instead of this, as shown in FIG. 5A, the invention may be applied to a cylinder block 3 having a casting portion 11 from which the extended portion 14 is removed.

In this case, a tapered cur surface fc is formed in a joined end portion m of a cylinder liner 1*a*, and the joined end portion m is cast by an inner expanded portion 111 at an upper end of a casting portion 11*a*, whereby a main part of the casting portion 11*a*, the inner expanded portion 111 and the joined end portion m are brought into a press contact with a lower wall surface of a cylinder head 4 via a gasket 5. Also, here, as has been described with reference to FIG. 3A, the tapered cut surface fc is formed at the inclination angle (15°) over the cut width B (>h+A), and an upwardly oriented surface fh at the joined end portion m is formed over a width i. In this case, the fastening load W is applied to the main part of the casting portion 11*a*, the inner expanded portion 111 and the joined end portion m, and the joined end portion m bears the fastening load W in a state in which it intersects with the fastening load W at right angles. In contrast, while the fastening load W borne by the inner expanded portion 111 is applied to the tapered cut surface fc, in this case, too, the joining properties between the casting portion 11*a* and spikes 13 which constitute an outer surface of a tubular portion 12*a* are held strongly in the tubular portion 12 at an area thereof which is situated below the cut width B, and the rigidity in configuration on the joined end portion m side is sufficiently secured, whereby a displacement V is suppressed.

Thus, as with the cylinder S shown in FIG. 1, also in a cylinder Sa in the cylinder block 3*a* shown in FIG. 5A, the casting portion 11*a* and the cylinder liner 1*a* having the spikes 13 are caused to adhere to each other strongly so that a damage to the gasket 5 is prevented, and in particular, by removing the spikes 13 from the vicinity of the inner expanded portion 111 by forming the tapered cut surface fc at the inclination angle over the cut width B, in the event that the fastening load W is applied from the cylinder head 4 side, the generation of a crack (refer to reference numeral 170 in FIG. 6B) from the spike 13 in the vicinity of the inner expanded portion 111 can be prevented in an ensured fashion, and a damage to the gasket 5, which would otherwise be caused if such a crack were generated, can be prevented, whereby the reduction in sealing properties between the cylinder block 3*a* and the cylinder head 4 can be prevented in an ensured fashion.

Figure 5B:
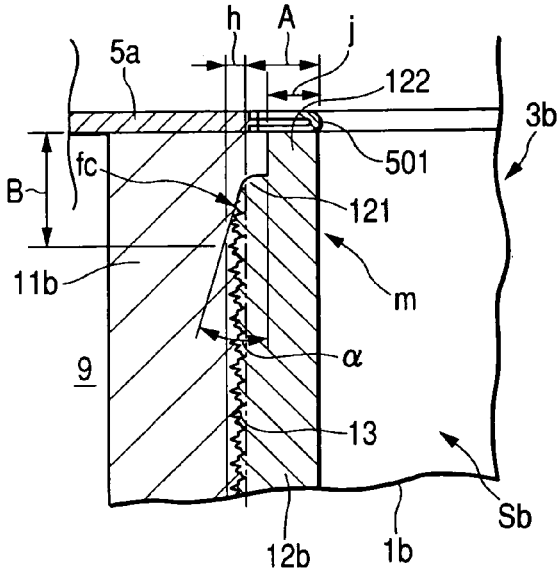

In the cylinder block 3*a* shown in FIG. 5A, while the tapered cut surface fc is continuously formed to the upper end of the joined end portion m of the cylinder liner 1*a*, as shown in FIG. 5B, a cylinder block 3*b* may be formed such that a radiused stepped portion 121 is formed on the upper end side of the tapered cut surface fc and is then cast by a casting portion 11*b*.

In this case, the tapered cut surface fc, the radiused stepped portion 121 and a tubular end portion 122 are formed over the cut width B in a joined end portion m of a cylinder liner 1*b*, and the joined end portion is cast by an inner expanded portion 112 at an upper end of the casting portion 11*b*, whereby a main part of the casting portion 11*b*, the inner expanded portion 112 and the joined end portion m are brought into a press contact with the lower wall surface of the cylinder head 4 via the gasket 5. Also, here, as has been described with reference to FIG. 3A, the tapered cut surface fc is formed at the inclination angle (15°) over the cut width B (>h+A), and, in particular, an upwardly oriented surface fh at the joined end portion m is formed over a width j by the tubular end portion 122.

Also with this cylinder block 3*b*, a substantially similar function and advantage to that obtained by the cylinder block 3*a* shown in FIG. 5A can be obtained. In particular, in the event that the width j of the upwardly oriented surface fh at the joined end portion m is reduced and a gasket 5*a* in which grommets are formed is used, a grommet 501 having a larger strength may be caused to face an upper end of a joint surface F1 between the inner expanded portion 112 and the tubular end portion 122 so as to suppress a damage to the same portion.

As has been described heretofore, while the cylinder block used in the engine cylinder liner construction is described as being cast in such a manner as to cast the cylinder liner thereinto using the high-pressure die casting method, the invention can be applied in a similar fashion to an engine cylinder block into which cylinder liners are cast using a gravity casting method.

What is claimed is:

1. An engine cylinder liner construction, comprising:

a cylinder block;

a cylinder liner cast into the cylinder block, the cylinder liner having a tubular portion and a number of spines integrally formed on an outer surface of the tubular portion; and a chamfered portion formed at an end portion of the tubular portion which faces a cylinder head by chamfering the end portion together with the spines located thereat, the chamfered portion having an extended width, in a radial direction of the cylinder liner, larger than a protrusion width of the spines in the radial direction of the cylinder liner and smaller than a thickness of the cylinder liner.

2. The engine cylinder liner construction as set forth in claim 1, wherein the chamfered portion is such that an angle of inclination relative to a cylinder center line is set to be about 12° to 30°.

3. The engine cylinder liner construction as set forth in claim 1, wherein a portion between the chamfered portion and an end face of the tubular portion which faces the cylinder head is rounded.

4. The engine cylinder liner construction as set forth in claim 1, wherein a cut width of the chamfered portion in a longitudinal direction of the cylinder liner is larger than a thickness of the cylinder liner including the spines.

5. An engine cylinder liner construction, comprising:

a cylinder block;

a cylinder liner cast into the cylinder block, the cylinder liner having a tubular portion and a number of spines integrally formed on an outer surface of the tubular portion, the cylinder liner being so cast, such that an annular extended portion extending from the cylinder block is sandwiched between an upper end portion of the cylinder liner and the cylinder head; and a chamfered portion formed at an end portion of the tubular portion which faces a cylinder head by chamfering the end portion together with the spines located thereat, the chamfered portion having an extended width in a radial direction of the cylinder liner larger than a protrusion width of the spines in the radial direction of the cylinder liner and smaller than a thickness of the cylinder liner.

6. The engine cylinder liner construction as set forth in claim 5, wherein the chamfered portion is such that an angle of inclination relative to a cylinder center line is set to be about 12° to 30°.

7. The engine cylinder liner construction as set forth in claim 5, wherein a portion between the chamfered portion and an end face of the tubular portion which faces the cylinder head is rounded.

8. The engine cylinder liner construction as set forth in claim 5, wherein a cut width of the chamfered portion in a longitudinal direction of the cylinder liner is larger than a thickness of the cylinder liner including the spines.

* * * * *

US007171935C1

(12) EX PARTE REEXAMINATION CERTIFICATE (6709th)

United States Patent
Komai et al.

(10) Number: US 7,171,935 C1
(45) Certificate Issued: Mar. 17, 2009

(54) ENGINE CYLINDER LINER CONSTRUCTION

(75) Inventors: Hirokazu Komai, Aichi (JP); Takeshi Hasegawa, Kyoto (JP)

(73) Assignee: Mitsubishi Motors Corporation, Minato-Ku, Tokyo (JP)

Reexamination Request:
No. 90/009,168, Jun. 18, 2008

Reexamination Certificate for:

| | |
|---|---|
| Patent No.: | **7,171,935** |
| Issued: | **Feb. 6, 2007** |
| Appl. No.: | **11/019,354** |
| Filed: | **Dec. 23, 2004** |

(30) Foreign Application Priority Data

Dec. 25, 2003 (JP) ..... P2003-431207

(51) Int. Cl.
*F02F 1/00* (2006.01)

(52) U.S. Cl. ..... 123/193.2

(58) Field of Classification Search ..... None
See application file for complete search history.

(56) References Cited

U.S. PATENT DOCUMENTS

| | | | |
|---|---|---|---|
| 2,062,394 | A | 12/1936 | Brown |
| 2,126,089 | A | 8/1938 | Brown |
| 3,641,882 | A | 2/1972 | Hall |
| 3,937,201 | A | 2/1976 | Howe |
| 4,399,783 | A | 8/1983 | Hauser, Jr. |
| 6,640,765 | B2 | 11/2003 | Land et al. |
| 6,925,981 | B2 | 8/2005 | Ibukuro et al. |

*Primary Examiner*—Peter C. English

(57) ABSTRACT

An engine cylinder liner construction in which a cylinder liner that is cast into a cylinder block has a tubular portion and a number of spines integrally formed on an outer surface of the tubular portion, the engine cylinder liner construction includes a chamfered portion formed at an end portion m of the tubular portion which faces a cylinder head by chamfering the end portion together with the spines located thereat in a tapered fashion.

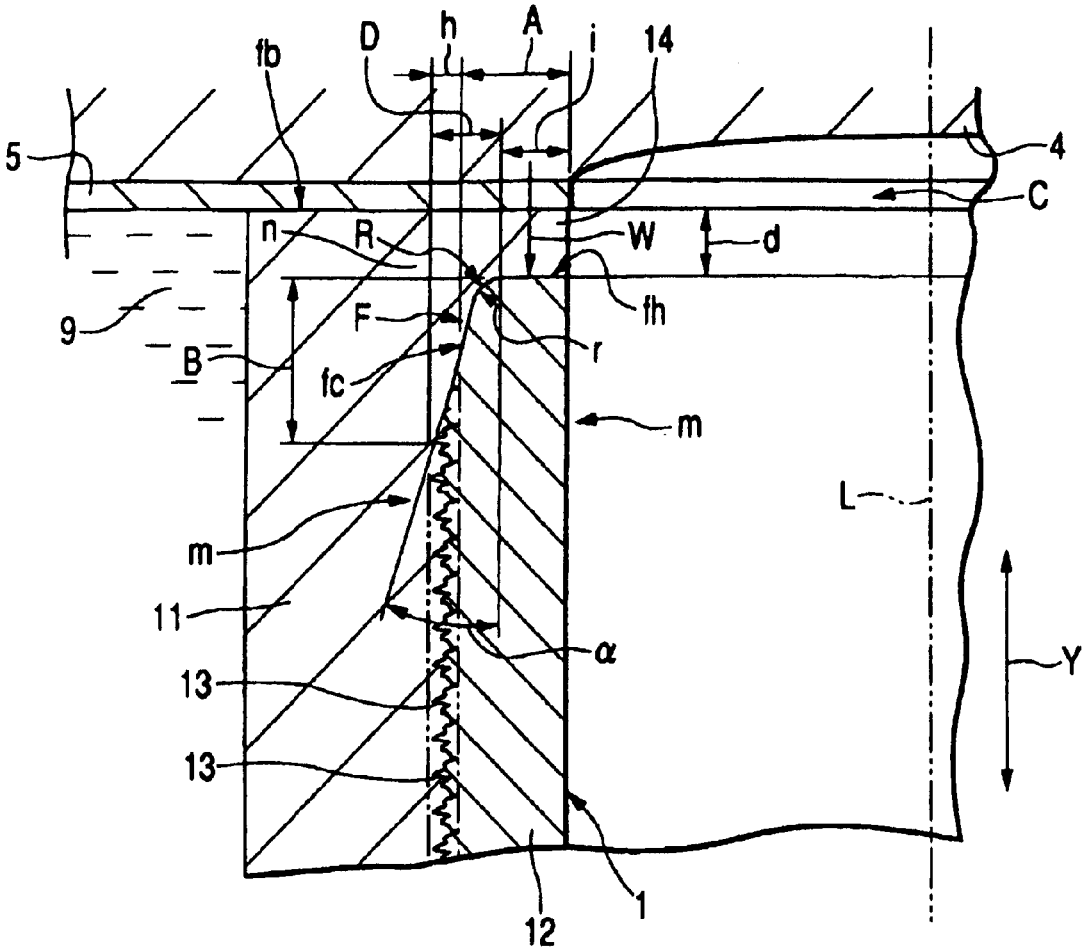

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *